United States Patent [19]

Rottinghaus

[11] Patent Number: 4,815,164

[45] Date of Patent: Mar. 28, 1989

[54] DOOR HINGE SPRING

[76] Inventor: Robert B. Rottinghaus, 4121 S. Caufield Rd., Jesup, Iowa 50648

[21] Appl. No.: 40,297

[22] Filed: Apr. 17, 1987

[51] Int. Cl.[4] ..... E05F 1/14; E05D 11/10

[52] U.S. Cl. ..... 16/296; 16/298; 16/308; 16/325; 16/344; 16/347; 16/DIG. 36; 296/146

[58] Field of Search ..... 16/296, 297, 298, 303, 16/308, 325, 333, 334, 335, 338, 344, 347, DIG. 27, DIG. 36; 296/146; 267/155, 157; 411/544, 10, 11, 12

[56] References Cited

U.S. PATENT DOCUMENTS

| | | | |
|---|---|---|---|
| 791,590 | 6/1905 | Stull | 411/544 |
| 1,317,963 | 10/1919 | Cosgrove | 411/544 |
| 1,470,583 | 10/1923 | Messenger | 267/155 |
| 2,602,957 | 7/1952 | Anderson | 16/338 |
| 3,183,762 | 5/1965 | Poupitch | 411/12 |
| 3,550,185 | 12/1970 | Marchione | 16/297 |
| 4,285,098 | 8/1981 | Hicks et al. | 16/308 |

FOREIGN PATENT DOCUMENTS

| | | | |
|---|---|---|---|
| 66794 | 12/1982 | Fed. Rep. of Germany | 411/11 |

*Primary Examiner*—Nicholas P. Godici
*Assistant Examiner*—Edward A. Brown
*Attorney, Agent, or Firm*—Emrich & Dithmar

[57] ABSTRACT

A door hinge torsion spring fixedly mounted at a first end thereof to one hinge member is engaged and deflected at a second end thereof by a second hinge member when the two hinge members are pivotally displaced relative to one another. An intermediate section of the spring is configured in the form of a coil for increasing the length of the spring and reducing the torque applied to the spring per unit length without increasing the mounting space required for the spring, while allowing the spring to be mounted to and operate with existing hinge configurations. The door hinge spring is particularly adapted for use in the door hinge of a vehicle such as a truck, wherein the second hinge member is provided with a pair of spaced, notched rollers for successively engaging the second end of the spring as the door is opened to either bias the door to the closed position or securely maintain the door in either a fully open position or in an intermediate position between full open and closed. The spring is comprised of a strong, resilient material such as steel and is configured for mounting to the hinge using existing hardware. Alternative embodiments make use of cone spring washers or a compression spring in mounting the door hinge spring to increase its resiliency.

17 Claims, 4 Drawing Sheets

FIG. 1
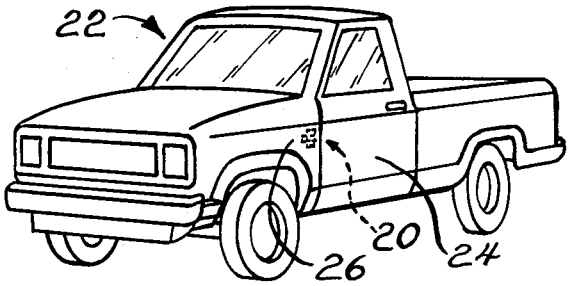
FIG. 2
PRIOR ART
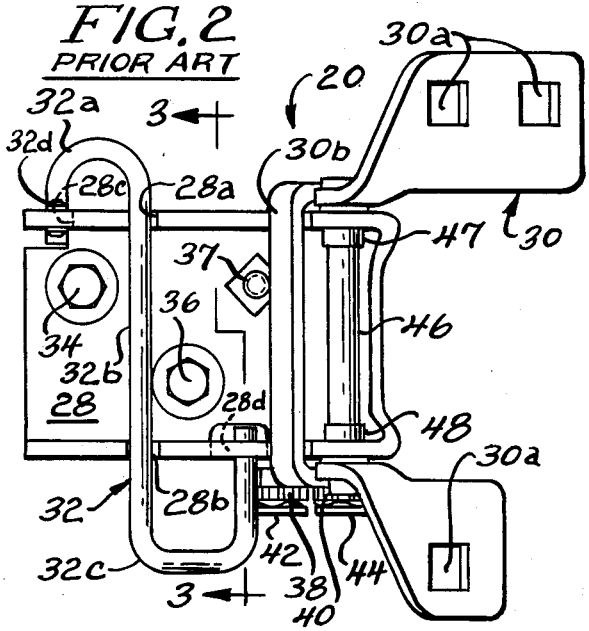
FIG. 5
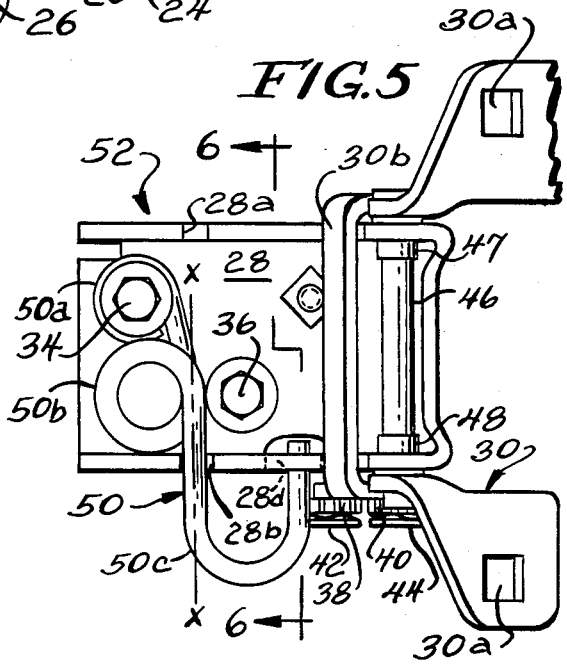
FIG. 3
PRIOR ART
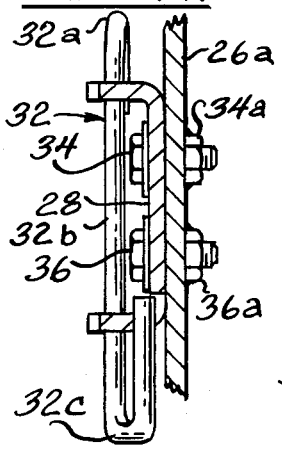
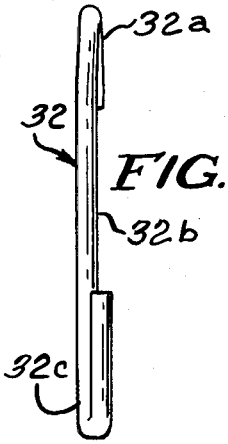
FIG. 4
FIG. 6
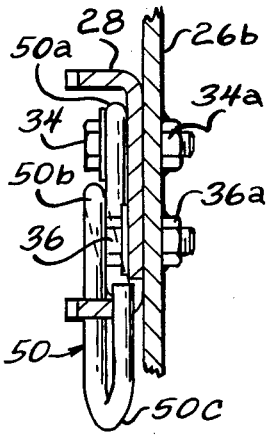
FIG. 7
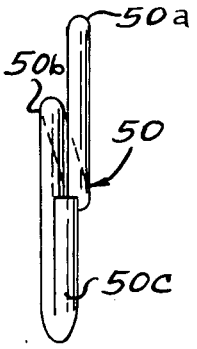

FIG. 8
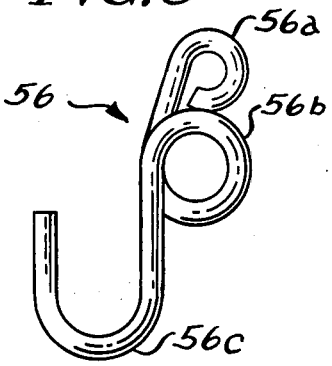
FIG. 9
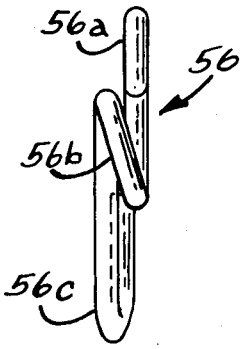
FIG. 10
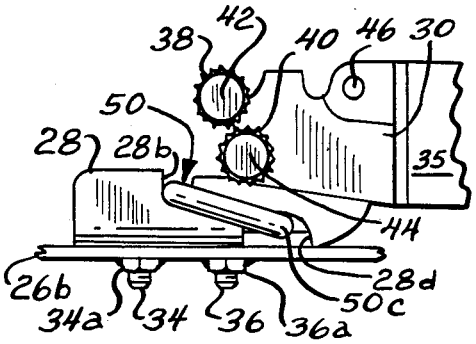
FIG. 11
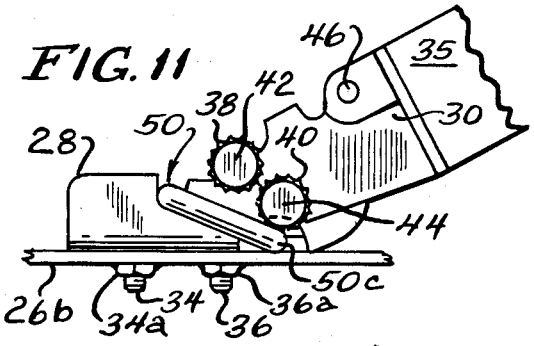
FIG. 12
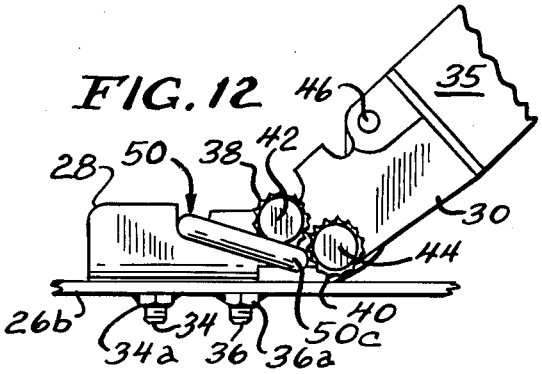
FIG. 13
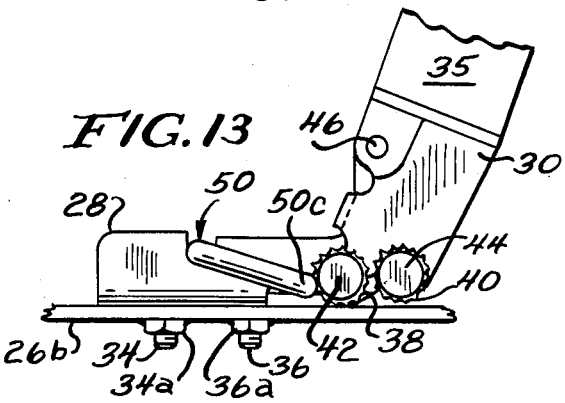
FIG. 14
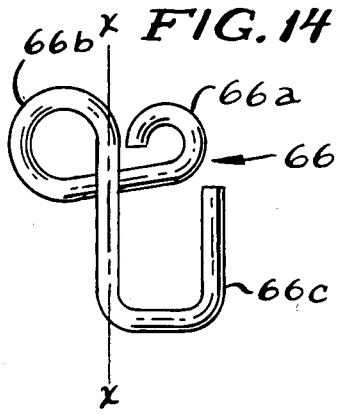
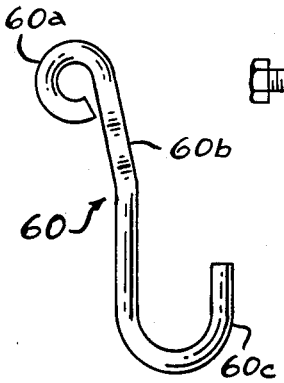
FIG. 16
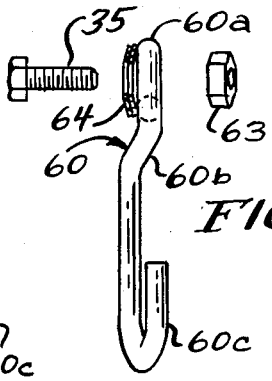
FIG. 17
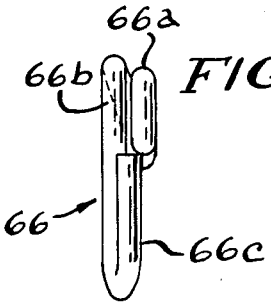
FIG. 15

FIG. 18
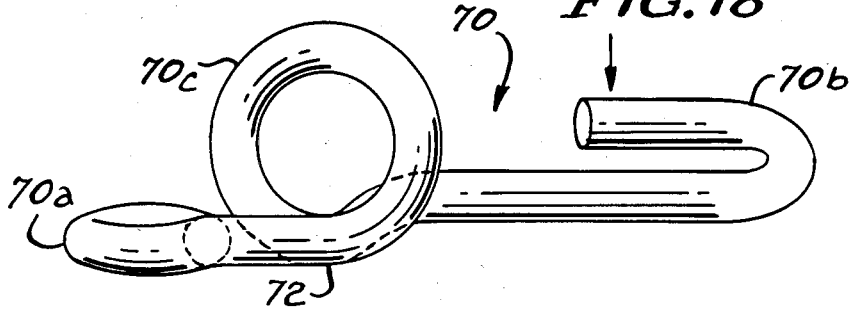
FIG. 19a
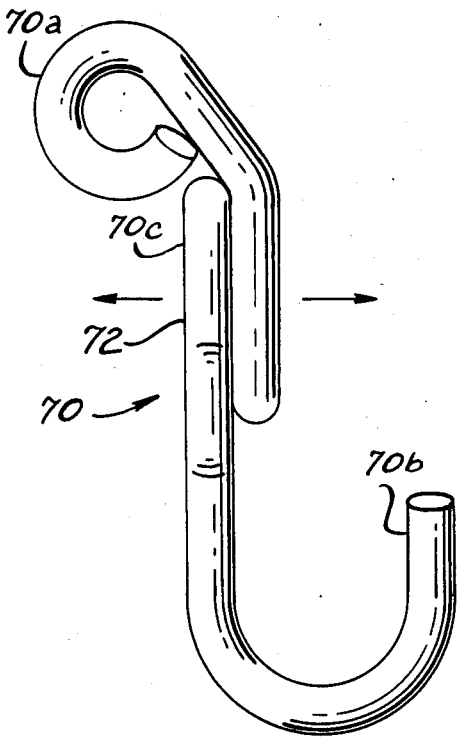
FIG. 19b
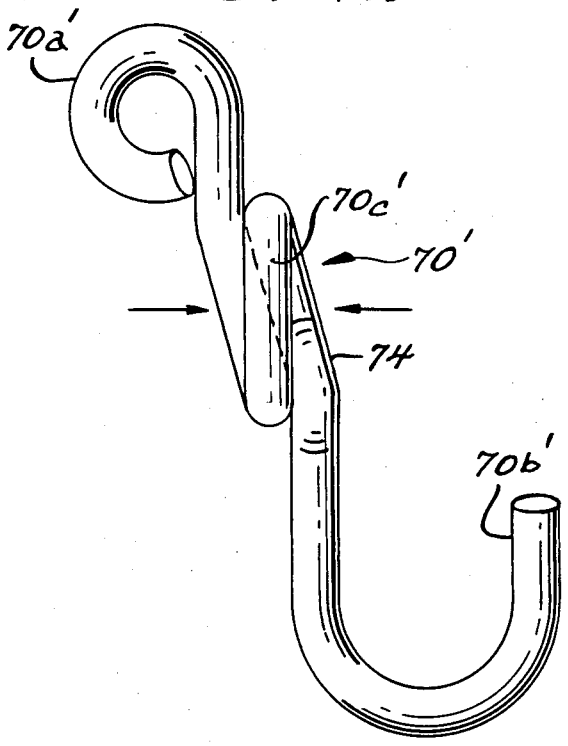
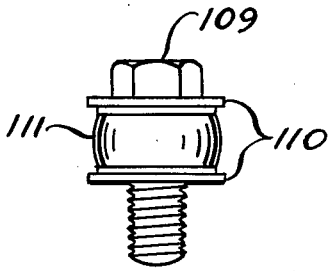
FIG. 23

FIG. 20
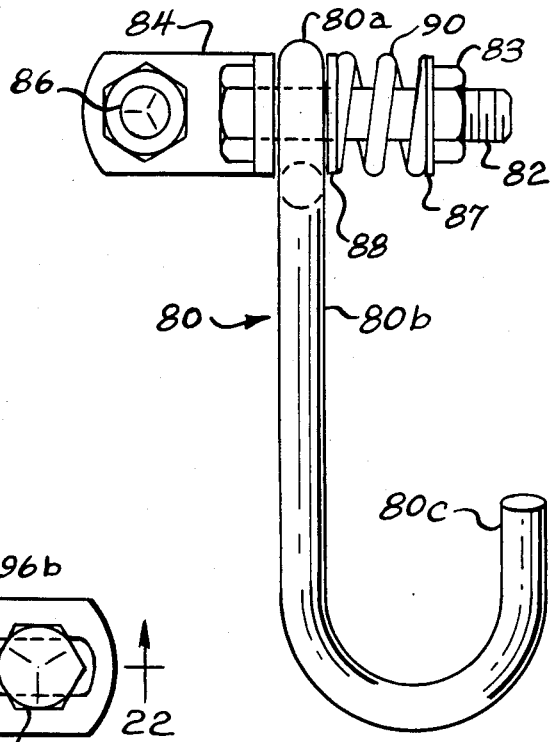
FIG. 21
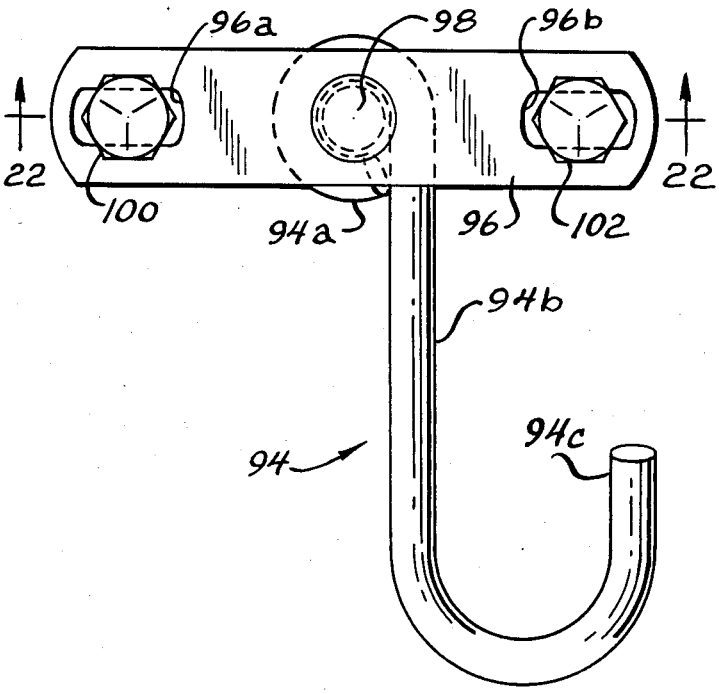
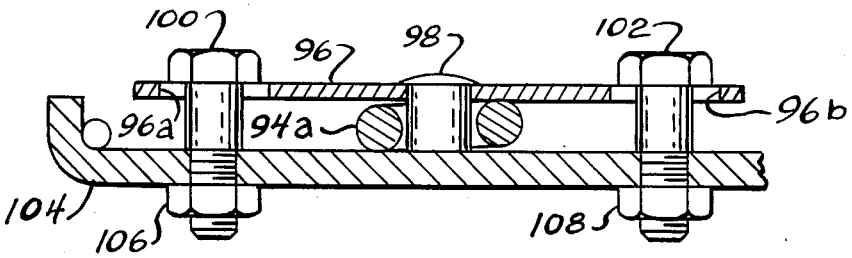
FIG. 22

DOOR HINGE SPRING

BACKGROUND OF THE INVENTION

This invention relates generally to a spring as used in a door hinge to bias the door to a closed position as well as to securely maintain the door in one or more open positions, and is particularly directed to a vehicle door hinge such as used in automobiles and trucks.

A door hinge used in a vehicle such as an automobile or a truck generally includes a resilient spring element for controlling the position of the door. For example, the spring typically biases the door to the closed position when the door is only slightly open. In addition, the spring ensures that the door remains in one or more open positions to prevent the door from closing upon a vehicle operator or passenger upon entering or exiting the vehicle. Generally, the spring maintains the door in a stable manner in the full open position as well as in an intermediate position between the full open and closed positions. The resilient spring typically engages a portion of the hinge attached to the door for urging the door to a given position or securely maintaining the door in a desired orientation. The force exerted by the spring upon the door can be overcome by the application of sufficient force upon the door by one entering or exiting the vehicle.

Referring to FIG. 1, there is shown a perspective view of a vehicle, in this case a pickup truck, 22 incorporating a door hinge 20 in which the spring of the present invention is intended for use. The door hinge 20 pivotally couples a door 24 of the vehicle to the vehicle's frame 26. The hinge 20 allows the door 24 to be pivotally displaced about a generally vertical axis as the door is opened and closed.

Referring to FIGS. 2 and 3, there are shown two views of a door hinge 20 incorporating a prior art spring 32. The prior art spring 32 is also shown in FIG. 4. The door hinge 20 is comprised of a first hinge member 28 pivotally coupled to a second hinge member 30 by means of a pivot pin 46. The first hinge member 28 includes a plurality of apertures (not shown) therein through which first and second mounting bolts 34 and 36 are inserted for attaching the first hinge member to a vehicle frame member 26*a*. Each of the mounting bolts 34, 36 engages a respective threaded nut 34*a*, 36*a* attached to an inner surface of the frame member 26*a*. A third nut and inverted sems bolt with captive washer combination 37 is also typically provided for securely mounting the first hinge member 28 to the vehicle frame 26*a*. The second hinge member 30 is comprised of upper and lower portions which are coupled together by means of an intermediate hinge portion 30*b*. Each of the upper and lower portions of the second hinge member 30 includes one or more apertures 30*a* through which a mounting bolt (not shown) may be inserted for securely attaching the second hinge member to a vehicle door (also not shown for simplicity).

The upper and lower ends of the pivot pin 46 coupling the first and second hinge members 28 and 30 are each configured to engage a respective portion of the second hinge member to prevent the removal of the pivot pin from the door hinge 20. This may be accomplished by any one of a number of processes such as crimping, notching, or otherwise deforming the ends of the pivot pin 46 so as to prevent its removal from the hinge. Positioned in a spaced manner along the length of the pivot pin 46 and adjacent to respective ends thereof are upper and lower bushings 47, 48. The upper and lower bushings 47, 48 are inserted through respective apertures in the first hinge member 28 and facilitate rotation of the pivot pin 46 and the second hinge member 30 with respect to the first hinge member.

A generally S-shaped spring 32 includes a first semicircular end 32*a*, a linear, elongated intermediate section 32*b*, and a double 90° bent second end 32*c*. The intermediate section 32*b* of the spring 32 is positioned within aligned notches 28*a* and 28*b* in upper and lower portions of the first hinge member 28 on a first side thereof. The distal portion of the first end 32*a* of the spring 32 is provided with a recess 32*d* for engaging a notch 28*c* in an upper portion of the first hinge member 28 on a second side thereof. Similarly, the distal portion of the second end 32*c* of spring 32 is adapted for positioning within another notch 28*d* in a lower portion of the first hinge member 28 on the second side thereof. Thus, the respective ends of the spring 32 are positioned within notches 28*c* and 28*d* on one side of the first hinge member 28, while the intermediate section 32*b* of the spring is positioned within aligned notches 28*a* and 28*b* on the other facing side of the first hinge member. The configuration and dimensions of the spring 32 are such that the spring is maintained under tension due to torsion applied to the intermediate section 32*b* of the spring along the length thereof. Thus, the spring 32 must be distorted in order to mount it upon the first hinge member 28 and it is this spring distortion which maintains the spring securely in position thereon. Because of the high strength of the spring 32 used in most vehicle door hinges, a special tool is required for mounting the spring in the hinge 20.

First and second notched, or segmented, striker rollers 38 and 40 are respectively positioned upon first and second mounting pins 42 and 44 which, in turn, are mounted to and extend from a lower portion of the second hinge member 30. Positioned between the end of each of the first and second mounting pins 42, 44 and the first and second notched rollers 38, 40 is a respective corrugated washer for maintaining a notched roller in position upon a mounting pin and providing resistance to its free rotation thereon. As the vehicle door (not shown), and thus the second hinge member 30, is rotationally displaced relative to the first hinge member 28 from the closed to the full open position, the second notch roller 40 first engages the second end 32*c* of the spring 32 and displaces this portion of the spring. Continued opening of the door results in the second spring end 32*c* being positioned generally between the first and second notched rollers 38, 40 which then function to securely maintain the vehicle door in an intermediate open position. Continued outward displacement of the door causes the first notched roller 38 to engage the second spring end 32*c* and to deflect this portion of the spring. Further displacement of the second hinge member 30 and door combination allows the second spring end 32*c* to assume its original position whereupon the vehicle door is biased to the full open position. The door may be closed by reverse rotational displacement of the second hinge member 30 relative to the first hinge member 28 and the successive engagement of the first and second notched rollers 38, 40 with the second spring end 32*c*. As the second spring end 32*c* is engaged and deflected by a respective notched roller, a torque is applied to the spring 32 about the longitudinal axis of its intermediate section 32*b* and the spring is thus subjected to a torsional force. When the spring 32 is repeatedly subjected to this torsional force over an extended period of time, it tends to break due to structural fatigue. The prior art spring 32 generally breaks in the area of the 90° bend junctures in its second end 32c after extended use.

Installation of the spring 32 requires the application of a large force thereto in order to configure it to fit the first hinge member 28 as previously described. This requires a specially designed machine or a unique tool when installation is performed by a worker. In addition, in order to ensure safety of the worker during spring installation a shield is generally positioned between the worker and the hinge. Because of the need for a special tool or machine to apply the required force to the spring and the danger involved in such an operation, failure of the spring requires replacement of the entire hinge assembly. This is an expensive repair for the vehicle owner not only because of the cost of the hinge assembly itself, but also because this removal and installation procedure requires approximately 1½ man-hours.

The present invention avoids the aforementioned limitations of the prior art by providing a door hinge spring which is easily and safely installed and does not require complete hinge replacement upon spring failure. The door hinge spring of the present invention also affords longer operating lifetime by reducing the torsional force per unit length applied to the spring during opening and closing of the door. The biasing force applied by the spring upon the door may also be varied in several embodiments of the inventive spring in order to establish the magnitude of the force required to move the door at a desired value.

OBJECTS OF THE INVENTION

Accordingly, it is an object of the present invention to provide an improved spring for use in a door hinge.

It is another object of the present invention to provide a hinge spring particularly adapted for use in a vehicle which is capable of biasing the door of the vehicle to a closed position as well as maintaining the door in a stable manner in one or more open positions.

Yet another object of the present invention is to provide a door hinge spring which affords improved spring resilience while reducing the torsion per unit length applied to the spring during displacement of a door mounted to and supported by the hinge.

A further object of the present invention is to facilitate and make safer the installation of a resilient spring in a door hinge such as used in a vehicle.

A still further object of the present invention is to provide a door hinge spring such as used in an automobile or a truck which can be easily mounted to existing hinge hardware without modification to the hinge or additional hardware in an arrangement which provides improved door control and longer spring operating life.

Another object of the present invention is to provide an arrangement for a door hinge spring in which spring tension and thus the force applied by the spring to maintain the door securely in one or more open positions may be adjusted as desired over a wide range of values.

Still another object of the present invention is to provide an installation arrangement for a door hinge spring wherein the torque applied to a spring mounting bolt establishes the force applied by the spring to the hinge in maintaining the door securely in one or more open positions as well as in biasing the door to the closed position.

A still further object of the present invention is to provide an inexpensive spring for use in a vehicle door hinge which is easily and safely installed in existing hinge arrangements yet offers substantial advantages over currently available door hinge springs.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

FIG. 1 is a perspective view of a pickup truck illustrating the location of a door hinge in which the spring of the present invention is intended for use;

FIG. 2 is a planar view shown partially in phantom of a door hinge incorporating a prior art spring;

FIG. 3 is a sectional view of the door hinge of FIG. 2 taken along sight line 3—3 therein;

FIG. 4 is a side view of the prior art spring used in the door hinge of FIG. 2;

FIG. 5 is a planar view of a door hinge incorporating a spring in accordance with the present invention;

FIG. 6 is a sectional view of the door hinge of FIG. 5 taken along sight line 6—6 therein;

FIG. 7 is a lateral view shown partially in phantom of a door hinge spring in accordance with one embodiment of the present invention;

FIGS. 8 and 9 illustrate two views of the mirror image of the door hinge spring illustrated in FIGS. 5, 6 and 7, wherein one spring configuration is used on one side of the vehicle and the other spring configuration is used on the other, facing side of the vehicle;

FIGS. 10–13 are bottom planar views of the hinge illustrated in FIG. 5 showing the displacement and relative orientation of various hinge components as the door is opened;

FIGS. 14 and 15 illustrate two views of another embodiment of a door hinge spring in accordance with the present invention;

FIGS. 16 and 17 illustrate two views of still another embodiment of a door hinge spring in accordance with the present invention which makes use of spring tension varying means;

FIG. 18 illustrates still another embodiment of a door hinge spring in accordance with the present invention;

FIGS. **19*a* and 19*b* illustrate two different shapes for the coiled portion of the spring of FIG. 18** as well as the direction of displacement of adjacent coiled spring portions upon application of a torsional force thereto;

FIG. 20 illustrates a hook-shaped door hinge spring and a mounting arrangement therefore which makes use of spring tension varying means in accordance with the present invention;

FIG. 21 is a front planar view shown partially in phantom of a mounting arrangement for a door hinge spring in accordance with the present invention;

FIG. 22 is a sectional view of the door hinge spring installation arrangement of FIG. 21 taken along sight line 22—22 therein; and FIG. 23 illustrates a resilient mounting arrangement for coupling the various embodiments of the spring of the present invention to a door hinge.

DETAILED DESCRIPTION OF THE PREFERRED EMBODIMENT

Referring to FIG. 5, there is shown a door hinge 52 incorporating a spring 50 in accordance with the principles of the present invention. The hinge 52 illustrated in FIG. 5 is identical in configuration to the hinge 20 illustrated in FIG. 2, with common identification numbers assigned to the same elements in these figures. A sectional view taken along sight line 6—6 in FIG. 5 of the door hinge 52 illustrated therein is shown in FIG. 6, while FIG. 7 is a lateral end-on view of the spring used in the door hinge of FIGS. 5 and 6.

As in the case of the door hinge illustrated in FIG. 2, the door hinge 52 illustrated in FIGS. 5 and 6 includes first and second hinge members 28 and 30 coupled by means of a pivot pin 46. The first hinge member 28 is adapted for secure mounting to a portion of a vehicle door frame **26*b* by means of first and second mounting bolts 34 and 36. The second hinge member 30 is similarly adapted for secure mounting to a lateral edge of a door (not shown) by means of mounting bolts (also not shown) inserted through respective apertures 30*a* in the upper and lower portions of the second hinge member. Respective ends of the pivot pin 46 are provided with an upper and a lower bushings 47 and 48 to facilitate rotational displacement of the pivot pin as well as the second hinge member 30 relative to the first hinge member 28**.

The spring 50 includes a first circular end **50*a*, a coiled intermediate section 50*b* and a U-shaped second end 50*c*. First and second mounting bolts 34, 36 in combination with respective washers, are inserted through respective apertures in the first hinge member 28 and the vehicle frame 26*b* and threadably engage first and second threaded nuts 34*a* and 36*a* which are securely mounted to the facing surface of the vehicle frame. In this manner, the hinge 52 may be securely mounted to the vehicle frame 26*b*. The first mounting bolt 34 is also inserted through the first circular end 50*a* of the spring 50 for attaching the spring to the first hinge member 28. As shown in FIG. 5, the portion of the spring 50 between its coiled intermediate section 50*b* and its second U-shaped end 50*c* is positioned within a first slot 28*b* in a lower angle of the first hinge member 28. The distal end of the U-shaped second end 50*c* of the spring 50 is similarly positioned within a second slot 28*d* in the first hinge member 28. Slots 28*b* and 28*d* are on facing surfaces of the first hinge member 28. With the first mounting bolt 34 inserted through the circular first end 50*a* of the spring 50, the first end of the spring may be drawn tightly up against and in contact with the first hinge member 28 causing the spring 50 to be rotationally displaced about the axis X-X illustrated in FIG. 5. This causes the distal portion of the second U-shaped end 50*c* of the spring to securely engage the second slot 28*d* in the first hinge member 28. Torsion is not applied to the spring 50 until the first mounting bolt 34 is tightened. A flat washer ensures secure engagement between the circular first end 50*a* of the spring 50 and the head of a mounting bolt 34**.

First and second notched or segmented striker rollers 38 and 40 are rotationally positioned upon respective first and second mounting pins 42 and 44 which are mounted to and extend downward from the second hinge member 30. As previously described, a corrugated washer is positioned between each of the notched rollers and a respective end of its associated mounting pin to securely maintain the roller on the mounting pin and to inhibit roller rotation for more securely maintaining a door attached to the second hinge member 30 in one or more open positions.

Referring to FIGS. 10–13, the operation of the door hinge spring 50 in biasing a door to the closed position as well as securely maintaining the door in one or more open positions will now be described. FIG. 10 illustrates the relative positions of the first and second hinge members 28, 30 as well as that of a door 35 securely bolted to the second hinge member, with the door in the closed position. With the door closed, neither of the first or second notched rollers 38, 40 engages the spring 50. As the door 35 is opened and the second hinge member 30 is pivotally displaced about the pivot pin 46 relative to the first hinge member 28, the second segmented roller 40 initially engages and deflects the distal portion of the second U-shaped end **50*c* of the spring 50 as shown in FIG. 11. This causes a torsion to be applied to the spring 50 not only about that portion of the spring disposed along the axis X—X, but this torsion is also applied to the coiled intermediate portion 50*b* of the spring forcing adjacent coiled portions of the spring apart. Continued opening of the door 35 results in positioning of the distal portion of the second U-shaped end 50*c* of the spring 50 between the first and second notched rollers 38, 40 as shown in FIG. 12. With the door hinge spring 50 thus positioned, the first and second notched rollers 38, 40 securely maintain the door 35** in an open position intermediate the closed and full open positions.

Continued opening of the door 35 results in engagement of the first notched roller 38 with the distal end portion of the second U-shaped end **50*c* of the spring 50 causing deflection of this portion of the spring and the application of a torsional force along the linear and coiled sections of the intermediate portion 50*b* of the spring. After the first notched roller 38 has been displaced over the distal portion of the second U-shaped end 50*c* of the spring 50 and the spring is allowed to resume its original and natural configuration, spring tension maintains the door 35 securely in the full open position as shown in FIG. 13. A key aspect of the present invention is an increase in the length of the spring 50 provided by its coiled intermediate portion 50*b* which distributes the torsional force applied to the spring over a greater effective spring length and reduces the stress per unit length applied to the door hinge spring. This reduction in per unit length stress on the door hinge spring 50** increases the operating life of the spring.

Another primary advantage of the door hinge spring 50 of the present invention is the manner in which it is mounted to the hinge 52. The distal end portion of the second U-shaped end **50*c* of the spring is first positioned in the second slot 28*d*, followed by positioning of the linear intermediate portion of the spring in the first slot 28*b*. The aperture in the circular first end 50*a* of the spring 50 is then aligned with a corresponding mounting aperture (not shown) in the first hinge member 28 and the first mounting bolt 34 is then inserted in this aperture for threaded engagement with threaded nut 34*a*. A washer positioned over the circular first end 50*a* of the spring 50 ensures that the head of the first mounting bolt 34 does not pass through the aperture in the spring's first end. This mounting procedure for the door hinge spring 50** allows the spring to be initially positioned in the hinge in a torsion-free state and for torsion to be gradually applied to the spring as the first mounting bolt 34 is tightened. Thus, once the door hinge spring 50 is secured to the first hinge member 28 by means of the first mounting bolt 34, the spring is not free to become separated from the hinge regardless of the torsional force applied to the spring as the first mounting bolt is tightened. This prevents the spring from injuring a worker installing the spring and requires only the tightening of a single bolt for spring installation. Thus, mounting and installation of the door hinge spring 50 of the present invention avoids the danger of prior art spring mounting and installation wherein improper securing of the spring under tension to the hinge frequently resulted in sudden release of spring tension and injury to the spring installer.

Referring to FIGS. 8 and 9, there is shown a door hinge spring 56 which is the mirror image of the door hinge spring 50 illustrated in FIGS. 5, 6 and 7. These mirror image springs are intended for use on opposite sides of the vehicle to accommodate reverse, or reciprocal, hinge installations. As in the case of the door hinge spring previously described, the door hinge spring 56 illustrated in FIGS. 8 and 9 includes a first generally circular end 56*a*, a coiled intermediate portion 56*b*, and a second U-shaped end 56*c*.

Referring to FIGS. 14 and 15, there is shown another embodiment of a door hinge spring 66 in accordance with the principles of the present invention. In the embodiment illustrated in FIGS. 14 and 15, the spring 66 also includes a first generally circular end 66*a*, a coiled intermediate portion 66*b*, and a generally U-shaped second end 66*c*. The circular first end 66*a* of the spring 66 is adapted to receive the second mounting bolt 36 illustrated in FIGS. 5 and 6 for mounting of the spring to the first hinge member 28 illustrated in these figures. Thus, the door hinge spring embodiments of FIGS. 5 through 7 and 14 and 15 allow for mounting of the door hinge spring to the first hinge member using either the first or second mounting bolts 34, 36 previously described. It should be noted that the hinge spring arrangement illustrated in FIGS. 14 and 15 requires the use of a stronger mounting bolt than that required for the spring of FIGS. 5–7. The second mounting bolt 36 used in mounting the door hinge spring 66 illustrated in FIGS. 14 and 15 is more likely to break than the first mounting bolt 34 used in the mounting of the spring embodiment illustrated in FIGS. 5 through 7 apparently because in the former arrangement the secured ends of the spring are disposed on the same side of the axis X—X of the linear intermediate portion of the spring. The symmetrical engagement about the torsion axis X—X of the first circular end 50*a* and the second U-shaped end 50*c* of the door hinge spring 50 results in the application of less force on the first mounting bolt 34 than that applied to the second mounting bolt in the spring arrangement of FIGS. 14 and 15.

Referring to FIGS. 16 and 17, there are shown two views of yet another embodiment of a door hinge spring 60 in accordance with the present invention. The door hinge spring 60 includes a first circular end 60*a* with an aperture therein, an angled intermediate portion 60*b*, and a second generally U-shaped end 60*c*. The intermediate angled portion 60*b* of the spring provides an offset, or riser, to accommodate the 90° angle formed in the lower edge of the first hinge member 28. The circular first end 60*a* of the door hinge spring 60 is adapted to receive the first mounting bolt 35, described above, for attaching the door hinge spring to the first hinge member 28. One or more cone spring washers 64 may be positioned on the first circular end 60*a* of the door hinge spring 60 in a stacked manner to provide additional resiliency for the spring. Various numbers of spring washers 64 may be disposed between the head of mounting bolt 35 and the first circular end 60*a* of the spring 60 to provide the desired resiliency in the mounting of the door hinge spring. Adjacent pairs of cone spring washers 64 may be positioned on the mounting bolt 35 in reverse orientation wherein the respective concave or convex surfaces are in facing relation in order to further increase the tension applied to the door hinge spring 60 in the manner in which it is mounted. It is this tension which is applied to the spring 60 which determines its resilience upon impact with the movable member of the hinge in which it is used. Finally, where the intermediate portion 60*b* of the door hinge spring 60 does not include a riser, but rather is in a straight or linear configuration, a spacer bushing 63 may be positioned between the circular end 60*a* of the spring and the hinge assembly in order to accommodate the 90° edge angle formed in the first hinge member.

Referring to FIG. 18, there is shown another embodiment of a door hinge spring 70 in accordance with the principles of the present invention. The door hinge spring 70 includes a first circular end 70*a* with an eyelet therein as well as a generally U-shaped second end 70*b*. Disposed along the length of the door hinge spring 70 between the respective ends thereof is a coiled intermediate portion 70*c* which is oriented generally transversely relative to the first and second ends of the spring. When a force is applied to the U-shaped end 70*b* of the spring in the direction indicated by the arrow in FIG. 18, the coils at a contact point in the intermediate portion 70*c* of the spring are forced apart under the load to utilize the full capability of the spring's resilience as shown by the direction of the arrows in FIG. 19*a*. The coiled portions of the door hinge spring 70 would typically be forced apart under a load when opening the vehicle door. By forcing the adjacent coil portions of the door hinge spring 70 apart upon the application of a force to one end thereof, the effective length of the spring with respect to the applied torque is increased so as to more evenly distribute the applied torque over the spring's entire length and provide the spring with increased effective resiliency.

Referring to FIG. 19*b*, there is shown another embodiment of a door hinge spring 70′ similar to that illustrated in FIGS. 18 and 19*a* wherein the spring includes an intermediate portion 74 having a double 45° bend therein. The double 45° bend in the intermediate section 74 of the spring 70′ provides a riser or offset to facilitate proper installation on a door hinge. In the case of the door hinge spring 70′ illustrated in FIG. 19*b*, a force applied to the distal portion of the U-shaped end 70*b*′ will apply pressure to intermediate spring portion 74 in the direction of the arrows forcing adjacent coiled spring portions together. The door hinge spring 70 illustrated in FIGS. 18 and 19*a* also incorporates an offset provided by an approximately 60° bend in the juncture between the spring's first circular end 70*a* and its coiled intermediate portion 70*c*. The eyelets included in the respective first circular end portions 70*a* of the springs 70 and 70′ illustrated in FIGS. 19*a* and 19*b* are adapted to receive a mounting bolt (not shown) for securely mounting the door hinge spring to a hinge member as previously described.

Referring to FIG. 20, there is shown another embodiment of a door hinge spring 80 in accordance with the present invention. The door hinge spring 80 is generally J-shaped and includes a circular first end 80*a* with an eyelet or aperture therein, an elongated, linear intermediate section 80*b*, and a generally U-shaped second end 80*c*. In this embodiment, an L-shaped bracket 84 is securely mounted to the first hinge member (not shown) by means of a first mounting bolt 86. A second mounting bolt 82 is inserted through a second aperture in the L-shaped bracket 84 and is further inserted through the eyelet in the spring's first circular end 80*a*. A compression spring 90 in combination with a pair of flat washers 87 and 88 each positioned in contact with a respective end thereof are positioned on the second mounting bolt 82. The combination of compression spring 90 and flat washers 87 and 88 is maintained in position on the second mounting bolt 82 by means of a self-locking nut 83. The torque applied to the self-locking nut 83 establishes the compression exerted on the first circular end 80*a* of the spring 80. In this manner, the resiliency of the spring installation as well as the force applied to the vehicle door in maintaining it in one or more open positions may be fixed as desired in accordance with the torque applied to the self-locking nut 83 in mounting the spring to the hinge. When installed in a hinge, the distal portion of the second U-shaped end 80*c* of the spring 80 is contacted and displaced by the notched rollers in the vehicle door hinge.

Referring to FIG. 21, there is shown yet another resilient mounting arrangement for a J-shaped door hinge spring 94 having a first circular end 94*a*, an elongated, linear intermediate section 94*b*, and a second U-shaped end 94*c*. FIG. 22 is a sectional view of the door hinge spring mounting arrangement of FIG. 21 taken along sight line 22—22 therein.

A dowel pin 98 is firmly affixed to a flat spring 98, with one end of the dowel pin positioned in contact with the hinge 104. The first circular end 94*a* of the spring 94 is positioned over the dowel pin 98. The outer diameter of the dowel pin 98 is less than the inside diameter of the first circular end 94*a* of the spring 94 and provides free torsional flexibility for the spring yet securely engages and maintains the door hinge spring in its proper position and orientation during displacement of the vehicle door. The resilient flat spring 96 is positioned adjacent to the first circular end 94*a* of the door hinge spring 94 for maintaining it in position upon the dowel pin 98. The flat spring 96 is, in turn, maintained in position upon and is coupled to the door hinge 104 by means of a pair of spaced shoulder bolts 100 and 102 respectively inserted through elongated slots 96*a* and 96*b* in the flat spring. Each of the shoulder bolts 100 and 102 is inserted within and threadably engages a respective threaded nut 106, 108 which are welded to the hinge 104. The shoulder bolts 100 and 102 are then tightened with a torque appropriate for the respective grade and size of the flat spring 96. The non-threaded, or shoulder, portion of the shoulder bolts 101, 102 may be provided in various incremental lengths to facilitate matching the tension to which these bolts are tightened with the grade and size of the flat spring 96. Thus, with the shoulder bolts tightened to a standard torque value, a longer shoulder portion of the bolt may be used with a stronger, more rigid flat spring while the length of the shoulder portion of the bolt may be shortened for more resilient flat springs in order to provide a standard spring mounting tension value. The force exerted on the first circular end 94*a* by the flat spring 96 provides the door hinge spring 94 with a resilient tension at the point where it is contacted by the segmented rollers of the hinge, i.e., adjacent to the distal portion of the U-shaped second end 80*c* of the spring. It is this portion of the J-shaped door hinge spring 94 which is engaged and deflected by the notched rollers in the vehicle door hinge. The elongated slots 96*a* and 96*b* in the flat spring provide free linear expansion and contraction of the flat spring when opening and closing the vehicle door and afford additional resiliency for the J-shaped door hinge spring 94. An inverted sems bolt typically is used to mount the hinge 104 to a support frame such as that of a vehicle as described earlier, although this is not shown in FIGS. 21 and 22 for simplicity.

Referring to FIG. 23, there is shown a resilient mounting arrangement adapted for use in the mounting of any of the above described embodiments of the spring of the present invention to a door hinge. The mounting arrangement of FIG. 23 includes a cap screw 109 inserted through an eyelet portion of any of the above described door hinge springs of the present invention for engaging a hinge-mounted threaded nut in mounting the spring to the hinge. Positioned along the length of the cap screw 109 and disposed between the screw head and the door hinge spring which it mounts to a hinge is the combination of two flat washers 110 and a resilient bushing 111 disposed therebetween. The resilient bushing 111 is comprised of a compressible material which provides another means for controlling the tension on the spring in its mounting to a door hinge. The two flat washers 110 separate the resilient bushing 111 from the cap screw head as well as from the eyelet portion of the door hinge spring and protect the compressible material of the resilient bushing from damage by spring movement. The compressibility of the resilient bushing 111 as well as the torque at which the cap screw 109 is tightened may be selected to provide a desired mounting tension for the door hinge spring.

There has thus been shown a door hinge torsion spring which allows the force applied to an open door mounted to the hinge to be varied as desired in maintaining the door in one or more fixed open positions. A resilient mounting arrangement is used for applying a force to the spring which can be varied over a wide range of values for increasing or decreasing the resiliency of the spring installation. In one embodiment in which spring mounting tension is not varied, an intermediate portion of the spring is provided with various shapes in order to increase the effective length of the spring and reduce the torsional force per unit length applied to the spring when the door is opened. By thus spreading the torsional force applied to the spring over a greater portion of its length and increasing the effective length of the spring, door hinge spring operating lifetime is increased. The various door hinge spring arrangements of the present invention are easily and safely installed using a single mounting bolt in most cases.

FIG. 24 no. 112 cross section of a J spring assembly attached to the vehicle hinge by capscrew no. 113.

The elastomer or resilient material no. 115 provides a torsional means for the spring. This material is bonded to the top end of the J spring as well as the metal, attaching component member no. 114. This can be square or hex to resist the torsional force.

FIG. 25 top view as follows:

No. 112 J spring

No. 113 Capscrew

No. 114 Metal attaching means

No. 115 Elastomer or resilient material

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A hinge for pivotally coupling a door to a frame, said hinge comprising:

a first hinge member;

mounting means for securely attaching said first hinge member to said frame;

a second hinge member mounted to the door;

coupling means for pivotally coupling said first and second hinge members;

a resilient spring securely coupled to said first hinge member by means of said mounting means; and engaging means coupled to said second hinge member and movable therewith for engaging said resilient spring whereupon the door is biased and maintained in a selected open position;

wherein said resilient spring includes a first end portion adapted to receive said mounting means for securely mounting said spring to said first hinge member, a second end portion movable in response to contact with said engaging means, and a coiled intermediate portion disposed between and coupled to said first and second end portions and responsive to a torsion force applied by said engaging means upon said spring for biasing the door to said selected open position.

2. The hinge of claim 1 wherein said first end portion of said spring includes an eyelet for receiving and engaging said mounting means.

3. The hinge of claim 1 wherein said second end portion of said spring is generally U-shaped and includes a distal portion which is displaced by said engaging means, whereupon a torsional force is exerted upon the coiled intermediate portion of said spring.

4. The hinge of claim 1 wherein said mounting means includes a threaded bolt.

5. The hinge of claim 1 wherein said engaging means includes at least one roller rotationally coupled to said second hinge member for engaging said resilient spring.

6. The hinge of claim 5 wherein said at least one roller has a notched outer surface around the periphery thereof.

7. The hinge of claim 1 wherein said engaging means includes a plurality of spaced, notched rollers rotationally coupled to said second hinge member for securely maintaining the door in a plurality of open positions.

8. The hinge of claim 1 further comprising variable tension means coupled to said mounting means for varying, as desired, the tension applied to said spring as it is mounted to said first hinge member.

9. The hinge of claim 8 wherein said variable tension means includes a flat spring mounted to said first hinge member and engaging the first end portion of said resilient spring.

10. The hinge of claim 8 wherein said variable tension means includes a coiled spring coupled to said first hinge member and engaging the first end portion of said resilient spring.

11. The hinge of claim 10 wherein said mounting means includes an L-shaped bracket affixed to said first hinge member and a threaded nut and bolt combination for engaging the first end portion of said resilient spring and said coiled spring in securely mounting said resilient spring to said L-shaped bracket.

12. The hinge of claim 1 wherein said mounting means includes a threaded mounting bolt and a compressible bushing disposed between said spring and said mounting bolt.

13. For use in a hinge in pivotally coupling a door to a support frame, said hinge including a first member, mounting means for fixedly coupling said first member to said support frame, a second member attached to said door, and coupling means for pivotally coupling said first and second members, wherein said second member includes an engaging member, a resilient spring comprising:

a first end portion adapted for engagement by said mounting means and secure attachment to said first hinge member;

a second end portion positioned in contact with said first hinge member and adapted for contact with and displacement by said engaging member when said second member is pivotally displaced relative to said first member upon opening of the door to a selected position; and a coiled intermediate section coupled to and disposed between said first and second end portions, wherein a torsional force is applied to said coiled intermediate section when said engaging member contacts and displaces said second end portion of the spring in biasing the door to said selected open position.

14. A spring as in claim 13 wherein said mounting means includes a threaded bolt and said first end portion of the spring includes an eyelet for receiving said threaded bolt in tight fitting engagement.

15. A spring as in claim 13 wherein said second end portion of the spring is generally U-shaped and includes a distal portion engaged and displaced by said engaging member.

16. A spring as in claim 13 wherein said spring is comprised of steel.

17. A spring as in claim 13 wherein said first end portion and said coiled intermediate section are each generally circular in shape.

* * * * *